US012117267B2

(12) United States Patent
Shi

(10) Patent No.: US 12,117,267 B2
(45) Date of Patent: Oct. 15, 2024

(54) DETACHABLE SIGHT WITH MOMENTARY SWITCH OF LIGHT WITH CONTROL LOGIC

(71) Applicant: Zi Qing Shi, Canton, MI (US)

(72) Inventor: Zi Qing Shi, Canton, MI (US)

( * ) Notice: Subject to any disclaimer, the term of this patent is extended or adjusted under 35 U.S.C. 154(b) by 0 days.

(21) Appl. No.: 17/684,796

(22) Filed: Mar. 2, 2022

(65) Prior Publication Data

US 2022/0187045 A1 Jun. 16, 2022

Related U.S. Application Data

(63) Continuation-in-part of application No. 16/805,788, filed on Mar. 1, 2020, now abandoned.

(51) Int. Cl.
*F41G 1/54* (2006.01)
*F41G 1/35* (2006.01)
*F41G 1/36* (2006.01)

(52) U.S. Cl.
CPC ..... *F41G 1/35* (2013.01); *F41G 1/36* (2013.01); *F41G 1/54* (2013.01)

(58) Field of Classification Search
CPC ..... F41G 1/35; F41G 1/36; F41G 1/54; F41G 1/545; F41G 11/003
USPC ..... 42/114–117
See application file for complete search history.

(56) References Cited

U.S. PATENT DOCUMENTS 4,825,258 A * 4/1989 Whitson ..... F41G 1/54 33/286
5,365,669 A * 11/1994 Rustick ..... F41A 33/02 33/DIG. 21
5,432,598 A * 7/1995 Szatkowski ..... F41G 1/545 356/153
5,486,913 A * 1/1996 Aharon ..... F41G 1/545 356/153
5,618,099 A * 4/1997 Brubacher ..... F41G 1/545 362/111
6,295,753 B1 * 10/2001 Thummel ..... F41A 33/02 42/116
6,406,298 B1 * 6/2002 Varshneya ..... F41A 33/02 434/19
6,622,414 B1 * 9/2003 Oliver ..... F41A 33/02 42/116
6,715,395 B1 * 4/2004 Heibel ..... F41A 19/58 180/287
6,796,480 B1 * 9/2004 Powers ..... B23K 1/0016 228/103
7,032,341 B1 * 4/2006 Sconce ..... F41G 1/18 42/111

(Continued)

*Primary Examiner* — Michael D David

(74) *Attorney, Agent, or Firm* — Ying-Ting Chen; Law Office of Michael Chen

(57) ABSTRACT

In one aspect, a sight with a momentary switch to control a laser beam on the sight may include a main power switch, a switch with momentary sensor, a plurality of locking screw to lock the sight onto a firearm, an orifice for emitting laser beams, a charging socket, and a laser adjustment screw. When in use, the user can press the main power switch to turn on the sight. In one embodiment, the switch with momentary sensor can emit infrared light and if the infrared light is deflected, the laser beam will be turned off. So, if the user wants to turn off the laser beam, the user can simply move the finger toward the momentary sensor to somewhat covers the momentary sensor to deflect the infrared light emitting therein.

8 Claims, 6 Drawing Sheets

(56) References Cited

U.S. PATENT DOCUMENTS 7,677,893 B2 * 3/2010 Lvovskiy ..... F41A 33/02 434/21
7,856,729 B1 * 12/2010 Pinto ..... F41G 5/26 33/286
7,900,391 B1 * 3/2011 Mihelish ..... F41A 31/02 42/116
8,117,780 B2 * 2/2012 Matthews ..... F41G 11/004 42/114
8,127,485 B2 * 3/2012 Moore ..... F41G 1/36 42/117
8,132,354 B1 * 3/2012 Sellers ..... F41G 1/54 42/116
8,312,665 B2 * 11/2012 Moore ..... F41G 1/35 42/114
8,510,981 B1 * 8/2013 Ganther ..... F41G 1/545 42/121
8,607,495 B2 * 12/2013 Moore ..... F41G 1/36 42/114
8,627,591 B2 * 1/2014 Moore ..... F41G 1/35 42/114
8,661,725 B1 * 3/2014 Ganther ..... F41G 1/545 42/121
8,695,266 B2 * 4/2014 Moore ..... F41G 1/44 42/116
8,696,150 B2 * 4/2014 Moore ..... F41G 1/35 362/110
8,739,677 B1 * 6/2014 Robbins ..... F41G 1/545 89/41.19
8,826,582 B2 * 9/2014 Bowman ..... F41G 1/35 42/115
8,844,189 B2 * 9/2014 Moore ..... F41G 1/36 42/115
9,170,079 B2 * 10/2015 Moore ..... F42B 12/42
9,182,194 B2 * 11/2015 Moore ..... F41G 11/003
9,297,614 B2 * 3/2016 Moore ..... F41G 1/35
9,513,086 B2 * 12/2016 Wenn ..... F41G 3/323
9,638,491 B2 * 5/2017 Challis ..... F41A 11/00
9,638,493 B2 * 5/2017 Bowman ..... F41G 1/387
9,644,826 B2 * 5/2017 Moore ..... F41G 1/35
9,829,280 B1 * 11/2017 Moore ..... F41J 5/18
10,591,250 B2 * 3/2020 Mock ..... G01R 27/2605
2012/0000979 A1 * 1/2012 Horvath ..... F41G 1/38 235/407
2012/0131840 A1 * 5/2012 Toole ..... F41G 1/35 42/114
2013/0098344 A1 * 4/2013 Morris, II ..... F41B 5/1469 124/25.6
2015/0171594 A1 * 6/2015 Serbicki ..... H01S 5/02345 372/38.02
2018/0254592 A1 * 9/2018 Serbicki ..... H01S 5/4087
2019/0137210 A1 * 5/2019 Moore ..... F41G 1/545

* cited by examiner

DETACHABLE SIGHT WITH MOMENTARY SWITCH OF LIGHT WITH CONTROL LOGIC

CROSS-REFERENCE TO RELATED APPLICATIONS

This application is a continuation-in-part (CIP) application of Ser. No. 16/805,788 filed on Mar. 1, 2020 now, the entire contents of which are hereby incorporated by reference.

FIELD OF THE INVENTION

The present invention relates to a detachable sight and more particularly to a detachable sight with control logic of the light thereon.

BACKGROUND OF THE INVENTION

There are basically two types of on/off switches for operating a laser or light. One is the permanent on/off switch, which has been used often in our daily life, such as a regular flashlight's push button switch and touch button switch. The other is the momentary switch, which has been used as an additional, usually optional, switch for the laser or light operating in shooting sports. The purpose of using this type of switch is to pursue fast, convenient, and conceal on/off operation of a gun laser or light during shooting.

There are different approaches for operating momentary switch, such as replacing the permanent on/off switch with a momentary on/off switch, building momentary function in a regular on/off switch, providing a build-in separate momentary switch, or providing a connection port for a detachable momentary switch. When a shooter presses on the momentary switch, it usually closes the circuit and turn on the laser or light. When release, it opens the circuit and turn off the laser or light. When both permanent and momentary switches are working concurrently, they are parallel connected as shown in FIG. 1. The momentary switch is now a "Normal Open Switch." In some cases, the momentary switches are spring tensioned.

Laser sights are particularly effective as sighting devices because the lasers illuminate spots on their targets and do not require users to align an eye with a sighting device, which can limit or obscure the user's view of the targets or their surroundings. When mounted on firearms, the laser sights emit beams that are directed along the expected flight paths of projectiles discharged from the firearms. Usually, the laser beam is triggered to turn on when the user pushes or touches the on button. In the present invention, with a different control logic, the laser beam can be triggered to "turn off" when the user touches the sensor on the sight.

The benefit of the present invention is the operation speed because for the natural of human beings, the action of moving a finger away from a switch is much faster and easier than finding and touching a switch. Thus, the control logic applied in the present invention is the fastest way to active a laser or light. In addition, using a touch senor switch would keep the on/off operation silent.

SUMMARY OF THE INVENTION

It is an object of the present invention to provide a detachable sight with a switch with a momentary sensor for a firearm to quickly activate a laser beam.

It is another object of the present invention to provide a detachable sight with a momentary sensor that can be used to shut off the laser beam of the sight when the user's finger blocks the momentary sensor.

In one aspect, a sight with a switch to control a laser beam thereon may include a main body, a main power switch, a switch with a momentary sensor, an orifice for emitting laser beams, a plurality of locking screws to lock the sight onto a firearm, a set of laser adjustment screws, and a charging socket. In one embodiment, the laser is tactical low-profile compact W/E adjustable laser. In another embodiment, the mode of the sight is switchable from constant to pulse, and vice versa. In another embodiment, the main power switch can be pushed to be ON or OFF. It is important to note that a further embodiment, the switch with momentary sensor can be easily controlled especially for silent and quick operation. In still a further embodiment, the charging socket has a built-in rechargeable battery compatible with USB Type-C charger.

The sight can be attached to a firearm with a rail. The user can first loosen the locking screws of the sight, push/hold the locking screws, align the locking screws with the groove of the rail of the firearm, clamp the sight onto the rail of the firearm, and tighten the locking screw to complete the mounting process.

When in use, the user can press the main power switch to turn on the sight. In one embodiment, the momentary sensor can emit infrared light and if the infrared light is deflected, the laser beam emitted from the orifice will be turned off. So, if the user wants to turn off the laser beam, the user can simply move the finger toward the switch with momentary sensor to somewhat covers the momentary sensor to deflect the infrared light emitting therefrom. In one use case, when the firearm with the sight is disposed into a gun bag, the momentary sensor can still be triggered to turn off the laser beam.

It is noted that the switch with momentary sensor is configured to temporarily shut off the laser beam. Namely, when the user moves the finger away from the momentary sensor, the infrared light emitting therefrom is not deflected and the laser beam from the orifice can again be turned on. It is also noted that the main power switch has to be "ON" to trigger the switch with momentary sensor.

In a further embodiment, the sight can be charged through the charging socket. More specifically, one end of a USB charging cable can be plugged into the charging socket on the sight and the other end can be connected to a USB power adapter to complete the charging process.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 1:
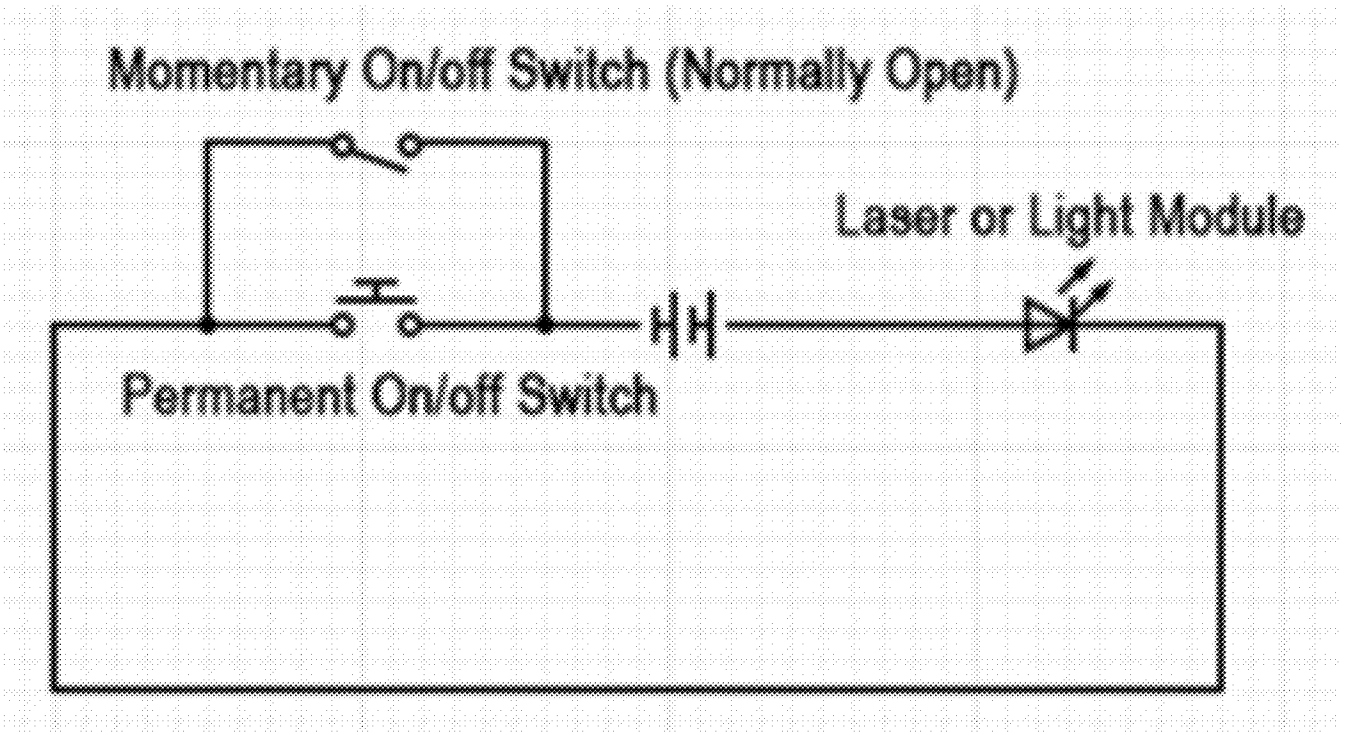
FIG. 1 (Prior Art)
FIG. 1 is a schematic view of a "Normal Open Switch."
Figure 2:
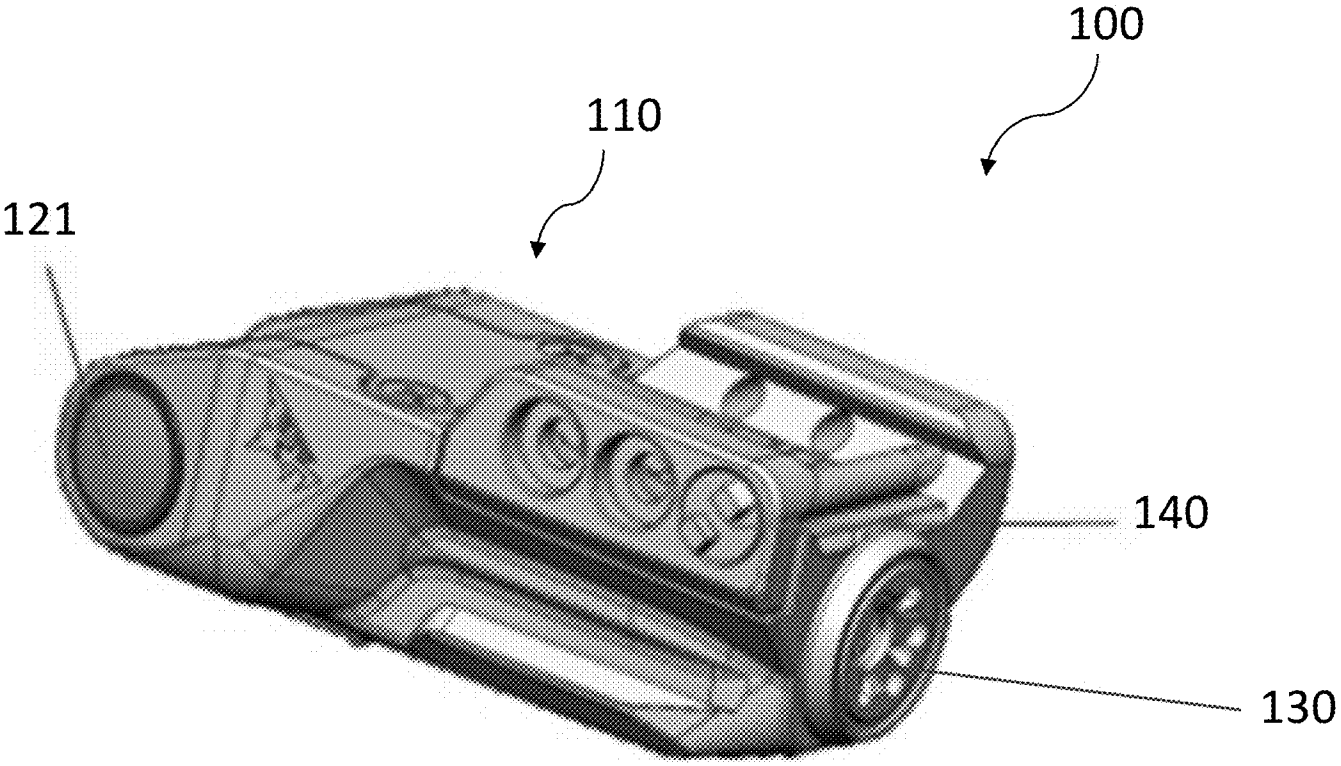
FIG. 2 is a schematic view of the sight with the switch with momentary sensor in the present invention.
Figure 3:
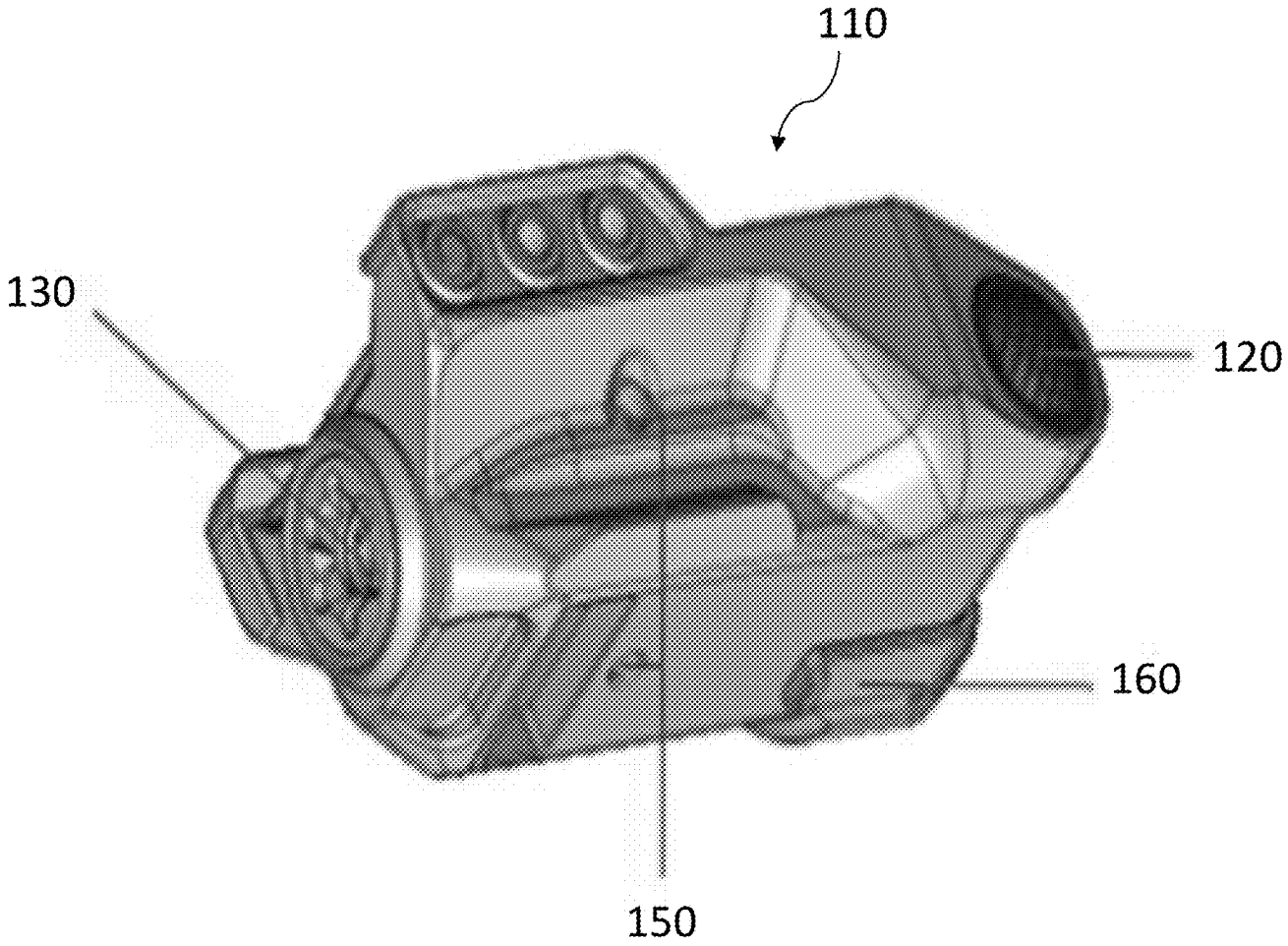
FIG. 3 is a schematic view from another view angle of the sight with main power switch in the present invention.

In one aspect, as shown in FIGS. 2 and 3, a sight 100 may include a main body 110, a main power switch 120, a switch with momentary sensor 121, an orifice 130 for emitting laser beams controlled by the main power switch 120 and the switch with momentary sensor 121, a plurality of locking screws 140 to lock the sight onto a firearm, a set of laser adjustment screws 150, and a charging socket 160. In one embodiment, the main body 110 is tactical low-profile and compact. In another embodiment, the laser beam emitted from orifice 130 is W/E adjustable. In another embodiment, the mode of the laser beam emitted from orifice 130 is switchable from constant to pulse, and vice versa. In another embodiment, the main power switch 120 can be pushed to be ON or OFF. It is important to note that a further embodiment, the switch with momentary sensor 121 can be easily controlled especially for silent and quick operation. In still a further embodiment, the charging socket 160 has a built-in rechargeable battery compatible with USB Type-C charger.

Figure 4:
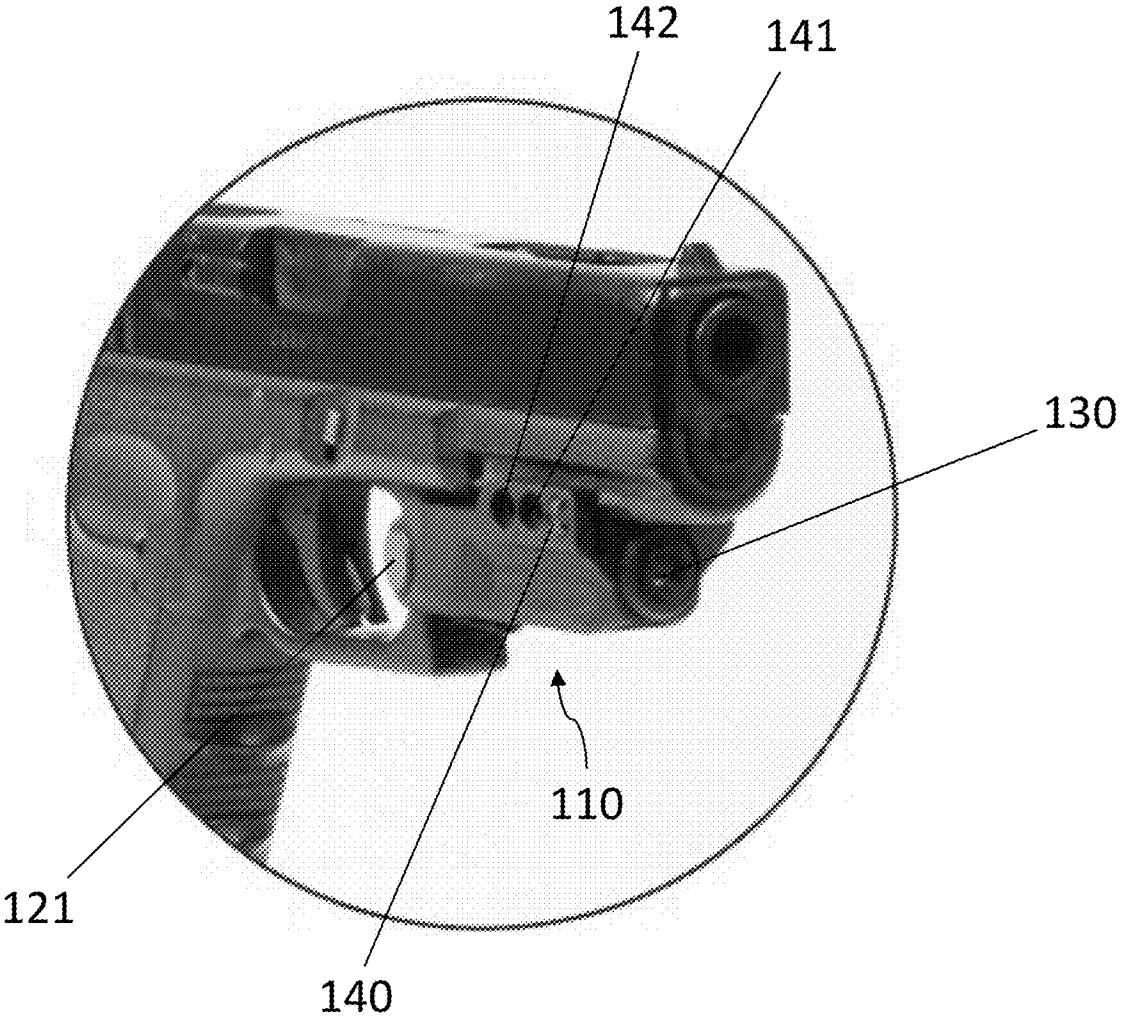
FIG. 4 is a schematic view of the sight with the switch with momentary sensor in the present invention mounted on a firearm.

The sight 100 can be attached to a firearm as shown in FIG. 4. The user can first loosen the locking screws 140 of the sight 100, push/hold the locking screws 140, align the locking screws 140 with the groove of the rail of the firearm, clamp the sight onto the rail of the firearm, and tighten the locking screw 140 to complete the mounting process.

Figure 5:
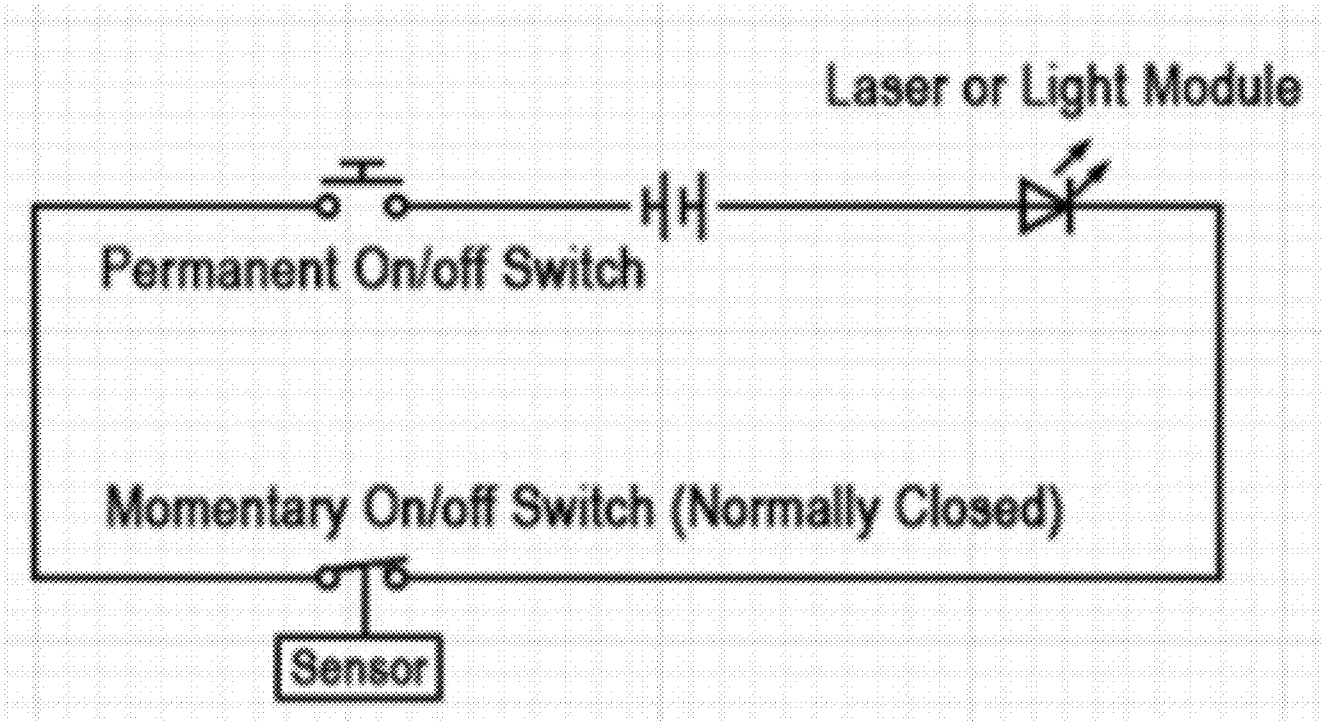
FIG. 5 is a schematic view of a "Normal Close Switch."

In an exemplary embodiment, a "Normal Close Switch" in the present invention is depicted in FIG. 5, where when the senor detects a reflection signal, the momentary switch would open the circuit and turn off the laser or light. On the other hand, when the reflection signal disappears, the momentary switch would close the circuit, and the laser would be turned on.

When in use, the user can press the main power switch 120 to turn on the sight 100. The switch with momentary sensor 121 is configured to periodically emit a testing light with a predetermined frequency and detect the strength of a reflexed testing light to determine whether to shut off the laser beams. In one embodiment, the momentary sensor can emit infrared light and if the infrared light is not deflected, the laser beam emitted from the orifice 130 will stay on according to the control logic shown in FIG. 5.

On the other hand, if the user wants to turn off the laser beam, the user can simply move the finger toward the switch with momentary sensor 121 to somewhat covers the switch with momentary sensor 121 to deflect the infrared light emitting therefrom. In one use case, when the firearm with the sight 100 is disposed into a gun bag, the switch with momentary sensor 121 can still be triggered to turn off the laser beam. For safety concerns, the user is required to put his/her index finger of the hand griping the pistol at finger rest position, i.e. on the side of the trigger guard, unless they are ready to shoot. It is noted that there are three mounting positions (140, 141, 142) on the sight 100 for user to adjust the mounting position to set the switches as much closer to the trigger guard as possible. Once the sight 100 are mounted at the position that user's index finger could reach, the user could use his index finger of the hand griping the pistol to temperately pause the laser. More importantly, when the user is ready to shoot, he merely needs to move the index finger away from the switch with momentary sensor 121 to the trigger, and the laser would be on at the moment of shooting. It is noted that the control logic in FIG. 5 applied in the present invention is the fastest way to active a laser.

It is also noted that the switch with momentary sensor 121 is configured to temporarily shut off the laser beam. Namely, when the user moves the finger away from the switch with momentary sensor 121, the infrared light emitting therefrom is not deflected and the laser beam from the orifice 130 can again be turned on. It is also noted that the main power switch 120 has to be "ON" to trigger the switch with momentary sensor 121.

Figure 6:
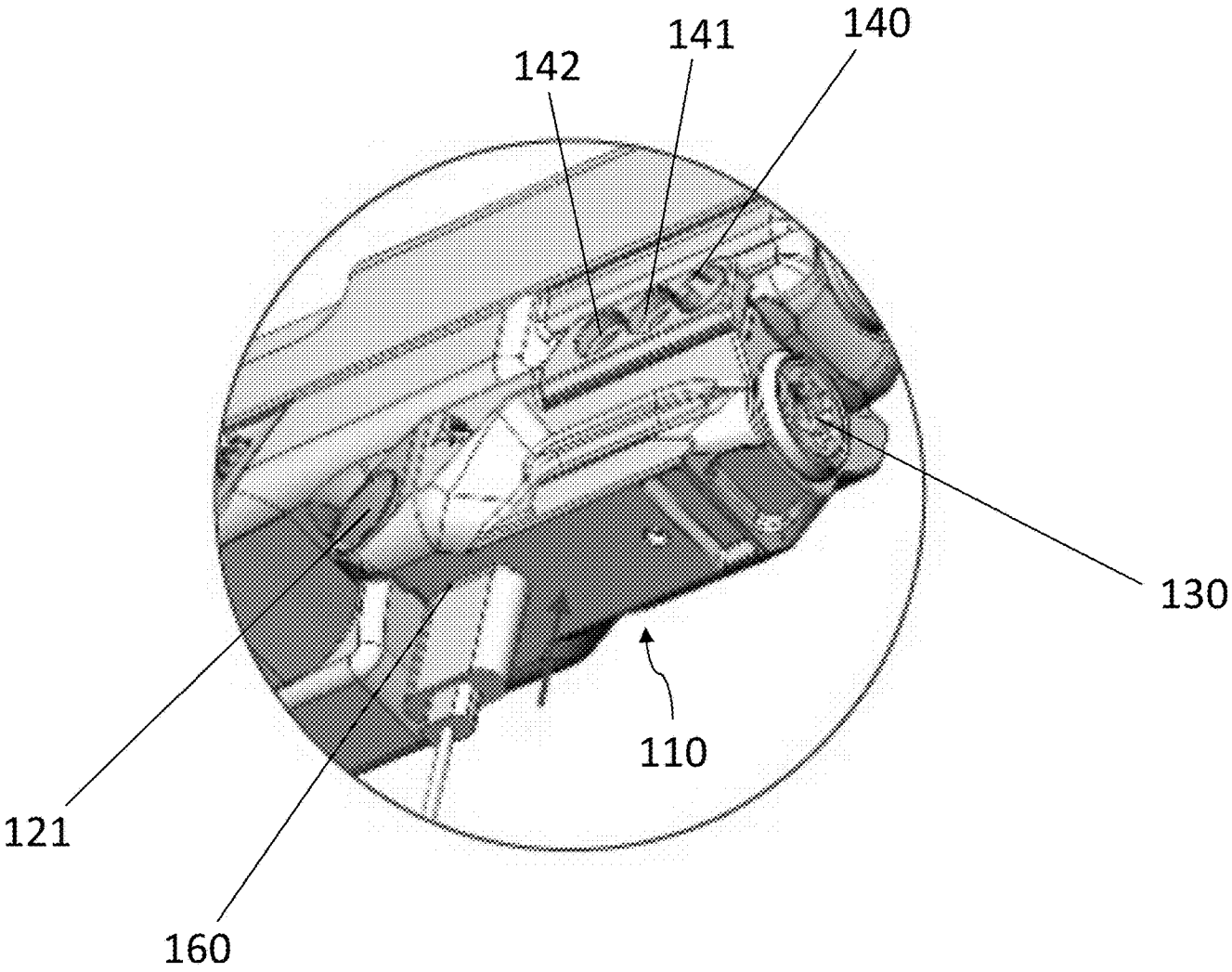
FIG. 6 illustrates a schematic view of the sight with the switch with momentary sensor in the present invention when being charged through the USB socket.

In a further embodiment, the sight can be charged through the charging socket 160. More specifically, as shown in FIG. 6, one end of a USB charging cable can be plugged into the charging socket 160 on the sight 100 and the other end can be connected to a USB power adapter to complete the charging process.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A method for operating a sight for a firearm, comprising:

providing the firearm that includes a sight main body; an orifice that emits a laser beam; a main power switch, and a switch with a momentary sensor to control the laser beam;

disposing the momentary sensor at a predetermined position that a user's finger is able to cover the momentary sensor while holding the firearm, wherein the momentary sensor is configured to work as a "Normal Close Switch" and is connected with the main power switch in a series manner;

configuring the momentary sensor to periodically emit a testing light with a predetermined frequency;

detecting the strength of a reflexed testing light to determine whether to temporarily shut off the laser beam, and determining whether the reflexed testing light is deflected, and if the reflexed testing light is not deflected, the laser beam will stay on, while the main power switch is on.

2. The method for operating a sight for a firearm of claim 1, wherein the laser beam can be shut off when the testing light is deflected to cause the change of the strength of the reflexed testing light.

3. The method for operating a sight for a firearm of claim 1, wherein the testing light is an infrared light.

4. The method for operating a sight for a firearm of claim 1, further comprising a locking screw to lock the sight onto a firearm.

5. The method for operating a sight for a firearm of claim 1, further comprising a set of laser adjustment screws, and a charging socket.

6. The method for operating a sight for a firearm of claim 2, wherein the testing light can be deflected to shut off the laser beam.

7. The method for operating a sight for a firearm of claim 5, wherein sight can be charged with a USB charging cable through the charging socket.

8. The method for operating a sight for a firearm of claim 1, wherein the main power switch has to be ON to trigger the switch with momentary sensor.

* * * * *